US006527049B2

(12) United States Patent
Metcalfe et al.

(10) Patent No.: US 6,527,049 B2
(45) **Date of Patent: *Mar. 4, 2003**

(54) APPARATUS AND METHOD FOR ISOLATING A SECTION OF TUBING

(75) Inventors: Paul David Metcalfe, Peterculter; Neil Andrew Abercrombie Simpson, Aberdeen, both of (GB)

(73) Assignee: Weatherford/Lamb, Inc., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/469,681

(22) Filed: Dec. 22, 1999

(65) Prior Publication Data

US 2002/0145281 A1 Oct. 10, 2002

(30) Foreign Application Priority Data

| | | |
|---|---|---|
| Dec. 22, 1998 | (GB) | 9828234 |
| Jan. 15, 1999 | (GB) | 9900835 |
| Oct. 8, 1999 | (GB) | 9923783 |
| Oct. 13, 1999 | (GB) | 9924189 |

(51) Int. Cl.[7] ..... E21B 23/00
(52) U.S. Cl. ..... 166/277; 166/206; 166/207
(58) Field of Search ..... 166/277, 207, 166/206; 72/120, 122

(56) References Cited

U.S. PATENT DOCUMENTS

| | | | |
|---|---|---|---|
| 761,518 A | 5/1904 | Lykken | |
| 958,517 A | 5/1910 | Mettler | 166/217 |
| 988,054 A | 3/1911 | Wiet | |
| 1,301,285 A | 4/1919 | Leonard | |
| 1,324,303 A | 12/1919 | Carmicheal | |
| 1,545,039 A | 7/1925 | Deavers | |
| 1,561,418 A | 11/1925 | Duda | |
| 1,569,729 A | 1/1926 | Duda | |
| 1,597,212 A | 8/1926 | Spengler | |
| 1,880,218 A | 10/1932 | Simmons | |
| 1,930,825 A | 10/1933 | Raymond | |
| 1,981,525 A | 11/1934 | Price | 166/4 |
| 2,017,451 A | 10/1935 | Wickersham | 166/10 |
| 2,214,226 A | 9/1940 | English | 166/1 |
| 2,383,214 A | 8/1945 | Prout | 153/82 |
| 2,424,878 A | 7/1947 | Crook | 154/82 |
| 2,499,630 A | 3/1950 | Clark | 153/81 |
| 2,519,116 A | 8/1950 | Crake | 166/10 |

(List continued on next page.)

FOREIGN PATENT DOCUMENTS

| | | | |
|---|---|---|---|
| DE | 3213464 A1 | 10/1983 | B23D/45/12 |
| DE | 4133802 C1 | 10/1992 | F16L/9/12 |
| EP | 0 952 305 A1 | 4/1998 | E21B/43/10 |

(List continued on next page.)

OTHER PUBLICATIONS

PCT International Search Report from PCT/GB99/04247, Dated Mar. 3, 2000.
Search Report from GB 9930396.8, Dated Jun. 5, 2000.
Metcalfe, P.—"Expandable Slotted Tubes Offer Well Design Benefits", *Petroleum Engineer International*, vol. 69, No. 10 (Oct. 1996), pp. 60–63—XP000684479.

*Primary Examiner*—Hoang Dang
(74) *Attorney, Agent, or Firm*—Moser, Patterson & Sheridan, L.L.P.

(57) ABSTRACT

A method of isolating a section of downhole tubing comprises: running a length of expandable tubing (20) into a tubing-lined borehole (12, 14) and positioning the expandable tubing (20) across a section of tubing to be isolated; deforming at least portions of the expandable tubing (36, 40) to increase the diameter of the portions to sealingly engage the tubing (14) and to isolate the tubing section.

30 Claims, 2 Drawing Sheets

U.S. PATENT DOCUMENTS

Figure 1:
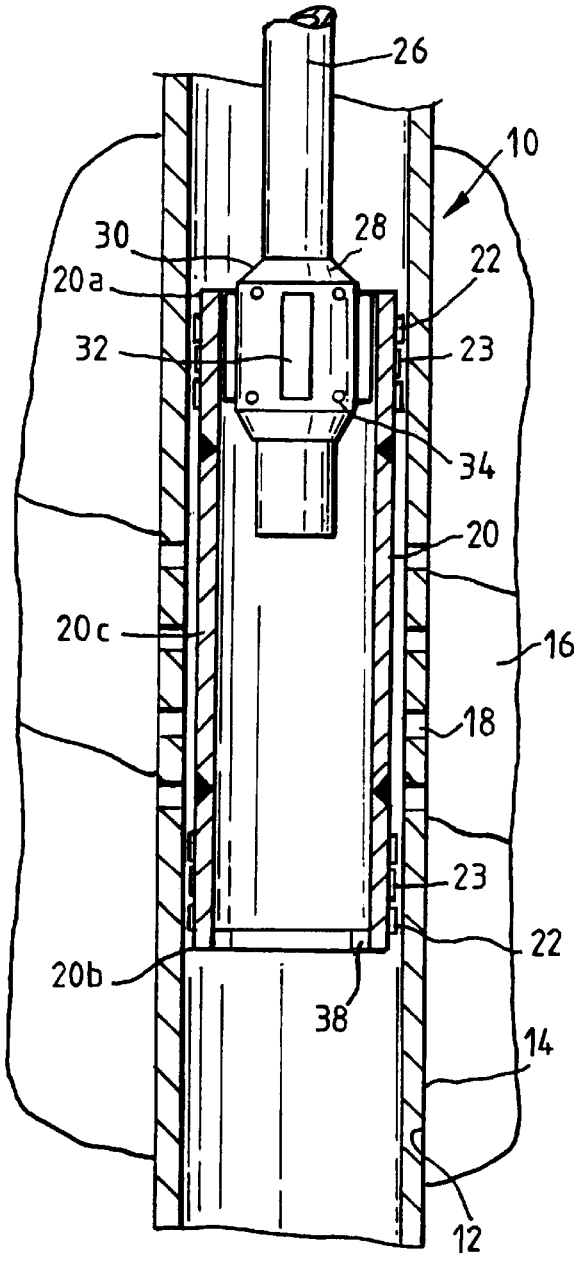

| | | | | |
|---|---|---|---|---|
| 2,575,938 | A | 11/1951 | Brenneke | 72/75 |
| 2,627,891 | A | 2/1953 | Clark | 153/82 |
| 2,633,374 | A | 3/1953 | Boice | 285/118 |
| 2,663,073 | A | 12/1953 | Bieber et al. | 29/148 |
| 2,767,766 | A | 10/1956 | Mathews | 72/122 |
| 2,898,971 | A | 9/1959 | Hempel | 153/82 |
| 3,028,915 | A | 4/1962 | Jennings | 166/16 |
| 3,039,530 | A | 6/1962 | Condra | 166/55 |
| 3,087,546 | A | 4/1963 | Wooley | 166/46 |
| 3,167,122 | A | 1/1965 | Lang | 166/14 |
| 3,179,168 | A | 4/1965 | Vincent | 166/14 |
| 3,186,485 | A | 6/1965 | Owen | 166/63 |
| 3,191,677 | A | 6/1965 | Kinley | 166/14 |
| 3,191,680 | A | 6/1965 | Vincent | 166/46 |
| 3,203,451 | A | 8/1965 | Vincent | 138/143 |
| 3,203,483 | A | 8/1965 | Vincent | 166/207 |
| 3,245,471 | A | 4/1966 | Howard | 166/46 |
| 3,297,092 | A | 1/1967 | Jennings | 166/207 |
| 3,326,293 | A | 6/1967 | Skipper | 166/150 |
| 3,353,599 | A | 11/1967 | Swift | 166/15 |
| 3,354,955 | A | 11/1967 | Berry | 166/14 |
| 3,412,565 | A | 11/1968 | Lindsey et al. | 405/231 |
| 3,467,180 | A | 9/1969 | Pensotti | 165/180 |
| 3,477,506 | A | 11/1969 | Malone | 166/207 |
| 3,489,220 | A | 1/1970 | Kinley | 166/277 |
| 3,583,200 | A | 6/1971 | Cvijanovic et al. | 72/393 |
| 3,669,190 | A | 6/1972 | Sizer et al. | 166/315 |
| 3,689,113 | A | 9/1972 | Blaschke | 285/90 |
| 3,691,624 | A | 9/1972 | Kinley | 29/523 |
| 3,712,376 | A | 1/1973 | Owen et al. | 166/277 |
| 3,746,091 | A | 7/1973 | Owen et al. | 166/207 |
| 3,776,307 | A | 12/1973 | Young | 166/125 |
| 3,780,562 | A | 12/1973 | Kinley | 72/479 |
| 3,785,193 | A | 1/1974 | Kinley et al. | 72/393 |
| 3,818,734 | A | 6/1974 | Bateman | 72/75 |
| 3,820,370 | A | 6/1974 | Duffy | 72/75 |
| 3,911,707 | A | 10/1975 | Minakov et al. | 72/76 |
| 3,948,321 | A | 4/1976 | Owen et al. | 166/277 |
| 3,977,076 | A | 8/1976 | Vieira et al. | 30/103 |
| 4,069,573 | A | 1/1978 | Rogers, Jr. et al. | 29/421 R |
| 4,127,168 | A | 11/1978 | Hanson et al. | 166/123 |
| 4,159,564 | A | 7/1979 | Cooper, Jr. | 29/727 |
| 4,288,082 | A | 9/1981 | Setterberg, Jr. | 277/125 |
| 4,319,393 | A | 3/1982 | Pogonowski | 29/434 |
| 4,324,407 | A | 4/1982 | Upham et al. | 277/27 |
| 4,349,050 | A | 9/1982 | Bergstrom et al. | 138/147 |
| 4,359,889 | A | 11/1982 | Kelly | 72/62 |
| 4,362,324 | A | 12/1982 | Kelly | 285/119 |
| 4,382,379 | A | 5/1983 | Kelly | 73/46 |
| 4,387,502 | A | 6/1983 | Dom | 29/568 |
| 4,407,150 | A | 10/1983 | Kelly | 72/61 |
| 4,414,739 | A | 11/1983 | Kelly | 29/727 |
| 4,429,620 | A | 2/1984 | Burkhardt et al. | 91/395 |
| 4,445,201 | A | 4/1984 | Pricer | 365/154 |
| 4,450,612 | A | 5/1984 | Kelly | 72/62 |
| 4,470,280 | A | 9/1984 | Kelly | 72/61 |
| 4,483,399 | A | 11/1984 | Colgate | 166/308 |
| 4,487,630 | A | 12/1984 | Crook et al. | 75/123 B |
| 4,502,308 | A | 3/1985 | Kelly | 72/58 |
| 4,505,142 | A | 3/1985 | Kelly | 72/54 |
| 4,505,612 | A | 3/1985 | Shelley, Jr. | 405/101 |
| 4,531,581 | A | 7/1985 | Pringle et al. | 166/120 |
| 4,567,631 | A | 2/1986 | Kelly | 29/157.3 |
| 4,581,617 | A | 4/1986 | Yoshimoto et al. | 346/108 |
| 4,588,030 | A | 5/1986 | Blizzard | 166/120 |
| 4,626,129 | A | 12/1986 | Kothmann et al. | 405/43 |
| 4,697,640 | A | 10/1987 | Szarka | 166/120 |
| 4,807,704 | A | 2/1989 | Hsu et al. | 166/313 |
| 4,830,109 | A | 5/1989 | Wedel | 166/277 |
| 4,866,966 | A | 9/1989 | Hagan | 72/75 |
| 4,883,121 | A | 11/1989 | Zwart | 166/217 |
| 4,976,322 | A | 12/1990 | Abdrakhmanov et al. | 175/57 |
| 4,997,320 | A | 3/1991 | Hwang | 408/22 |
| 5,014,779 | A | 5/1991 | Meling et al. | 166/55.7 |
| 5,052,483 | A | 10/1991 | Hudson | 166/55 |
| 5,052,849 | A | 10/1991 | Zwart | 403/300 |
| 5,156,209 | A | 10/1992 | McHardy | 166/324 |
| 5,267,613 | A | 12/1993 | Zwart et al. | 166/178 |
| 5,271,472 | A | 12/1993 | Leturno | 175/107 |
| 5,301,760 | A | 4/1994 | Graham | 175/61 |
| 5,307,879 | A | 5/1994 | Kent | 166/382 |
| 5,322,127 | A | 6/1994 | McNair et al. | 166/313 |
| 5,348,095 | A | 9/1994 | Worrall et al. | 166/380 |
| 5,366,012 | A | 11/1994 | Lohbeck | 166/277 |
| 5,409,059 | A | 4/1995 | McHardy | 166/208 |
| 5,435,400 | A | 7/1995 | Smith | 175/61 |
| 5,472,057 | A | 12/1995 | Winfree | 175/57 |
| 5,520,255 | A | 5/1996 | Barr et al. | 175/24 |
| 5,553,679 | A | 9/1996 | Thorp | 175/73 |
| 5,560,426 | A | 10/1996 | Trahan et al. | 166/120 |
| 5,636,661 | A | 6/1997 | Moyes | 137/614.2 |
| 5,667,011 | A | 9/1997 | Gill et al. | 166/295 |
| 5,685,369 | A | 11/1997 | Ellis et al. | 166/195 |
| 5,706,905 | A | 1/1998 | Barr | 175/61 |
| 5,785,120 | A | 7/1998 | Smalley et al. | 166/55 |
| 5,887,668 | A | 3/1999 | Haugen et al. | 175/79 |
| 5,901,787 | A | 5/1999 | Boyle | 166/135 |
| 5,901,789 | A | 5/1999 | Donnelly et al. | 166/381 |
| 5,924,745 | A | 7/1999 | Campbell | 285/90 |
| 5,960,895 | A | 10/1999 | Chevallier et al. | 175/27 |
| 5,979,571 | A | 11/1999 | Scott et al. | 175/61 |
| 6,029,748 | A | 2/2000 | Forsyth et al. | 166/380 |
| 6,070,671 | A | 6/2000 | Cumming et al. | 166/381 |
| 6,098,717 | A | 8/2000 | Bailey et al. | 166/382 |

FOREIGN PATENT DOCUMENTS

| | | | |
|---|---|---|---|
| EP | 0 961 007 | 12/1999 | E21B/33/10 |
| GB | 730338 | 3/1954 | 84/4 |
| GB | 792886 | 4/1956 | |
| GB | 997721 | 7/1965 | |
| GB | 1277461 | 6/1972 | B21D/39/04 |
| GB | 1448304 | 9/1976 | E21B/33/13 |
| GB | 1457843 | 12/1976 | B21D/39/10 |
| GB | 1582392 | 1/1981 | B21D/39/10 |
| GB | 2216926 A | 10/1989 | E21B/7/20 |
| GB | 2 313 860 B | 6/1996 | E21B/10/34 |
| GB | 2 320 734 | 7/1998 | E21B/33/127 |
| GB | 2329918 A | 4/1999 | E21B/43/10 |
| WO | WO 92/01139 | 1/1992 | E21B/17/08 |
| WO | WO 93/24728 | 12/1993 | E21B/17/10 |
| WO | WO 93/25800 | 12/1993 | E21B/43/10 |
| WO | WO 94/25655 | 11/1994 | D04C/1/06 |
| WO | WO 97/21901 | 6/1997 | E21B/17/08 |
| WO | WO 98/00626 | 1/1998 | E21B/43/10 |
| WO | WO 99/02818 | 1/1999 | E21B/43/10 |
| WO | WO 99/18328 | 4/1999 | E21B/23/01 |
| WO | WO 99/23354 | 5/1999 | E21B/43/10 |

APPARATUS AND METHOD FOR ISOLATING A SECTION OF TUBING

This invention relates to a straddle, and in particular a straddle for use in selectively isolating a section of tubing. The invention also relates to a method of isolating a section of tubing.

In the oil and gas exploration and production industries, subsurface hydrocarbon-bearing formations are accessed via casing-lined wellbores. The lower section of a bore, which intersects the hydrocarbon-bearing formation, is typically lined with perforated "liner", oil and gas flowing into the bore through the perforations. The location of the perforations is predetermined on the basis of surveys, to ensure that only selected formations ate in fluid communication with the bore. Over the life of a well it may occur that the properties of particular formations change, for example the pressure in a formation may fall, or a formation may begin to produce an unacceptably high volume of water. In these circumstances it is known to run straddles into the liner, these straddles being sections of tubing with sealing arrangements at either end. A straddle may be located within the section of liner intersecting the problem formation, and the seals then set to isolate the section of liner between the seals. However, existing straddles are problematic to set, and the requirement to accommodate the seals and a seal setting mechanism result in a significant loss in bore cross section, which reduces the production capacity of the well and also makes it more difficult to access the section of well beyond the straddle.

It is among the objectives of embodiments of the present invention to provide an improved straddle which obviates or mitigates these difficulties.

According to the present invention there is provided a method of isolating a section of downhole tubing, the method comprising:

running a length of expandable tubing into a tubing-lined borehole and positioning the expandable tubing across a section of tubing to be isolated; and deforming the expandable tubing by increasing the diameter of at least portions thereof to sealingly engage the tubing and to isolate said section.

According to another aspect of the present invention there is provided apparatus for use in isolating a section of tubing-lined borehole, the apparatus comprising: a length of expandable tubing; and an expander device including a radially extendable member for deforming at least portions of the expandable tubing to increase the diameter of said portions to sealingly engage a section of tubing to be isolated.

Preferably, the expandable tubing is deformed by compressive plastic deformation or yield of the tubing and a localised reduction in tubing wall thickness with a subsequent increase in tubing diameter. Conveniently this is achieved by rolling expansion, that is the expander device is rotated within the expandable tubing with an expander member in rolling contact with an inner face of the expandable tubing.

The deformation of the expandable tubing preferably creates an annular extension. This annular extension may extend over all or a substantial portion of the expandable tubing, or may be restricted to a selected portions of the expandable tubing on either side of the section of tubing to be isolated. The former arrangement will be more secure, but would be more difficult to remove from the tubing.

The tubing lining the bore may be casing or liner, or may be secondary tubing, such as production tubing itself positioned within a section of casing or liner.

The expandable tubing may include relatively ductile portions corresponding to the portions of the tubing to be expanded. These portions may be welded or otherwise secured to portions of less ductile tubing.

The expandable tubing is preferably initially cylindrical.

Preferably, the expander device comprises a body carrying a plurality of expander roller members. Most preferably, a plurality of the expander members are radially extendable. Preferably, the expander members are fluid activated, for example the members may be operatively associated with a piston. In one embodiment, the members may be mounted on respective radially movable pistons and in other embodiments the members may have tapered ends for engaging cones or wedges coupled to an axially movable piston.

The expandable tubing may carry seal bands on an outer surface thereof. The seal bands may comprise at least one of an elastomeric seal and a hand of relatively ductile metal, such as copper or a tin/lead alloy.

The expandable tubing may carry grip bands on an outer surface thereof. The grip bands may comprise relatively hard elements, such as balls, chips or grains, held in a matrix, whereby the elements bite into the relatively soft material of the tubing and the expandable tubing on deformation of the expandable tubing. In other embodiments the relatively hard elements may be in a form other than bands.

Figure 2:
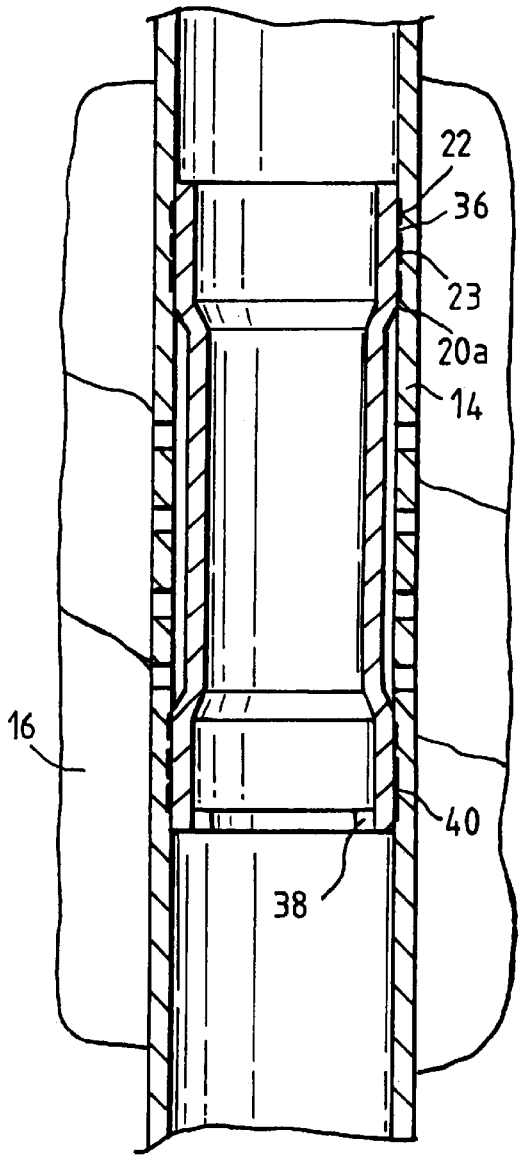
Figure 3:
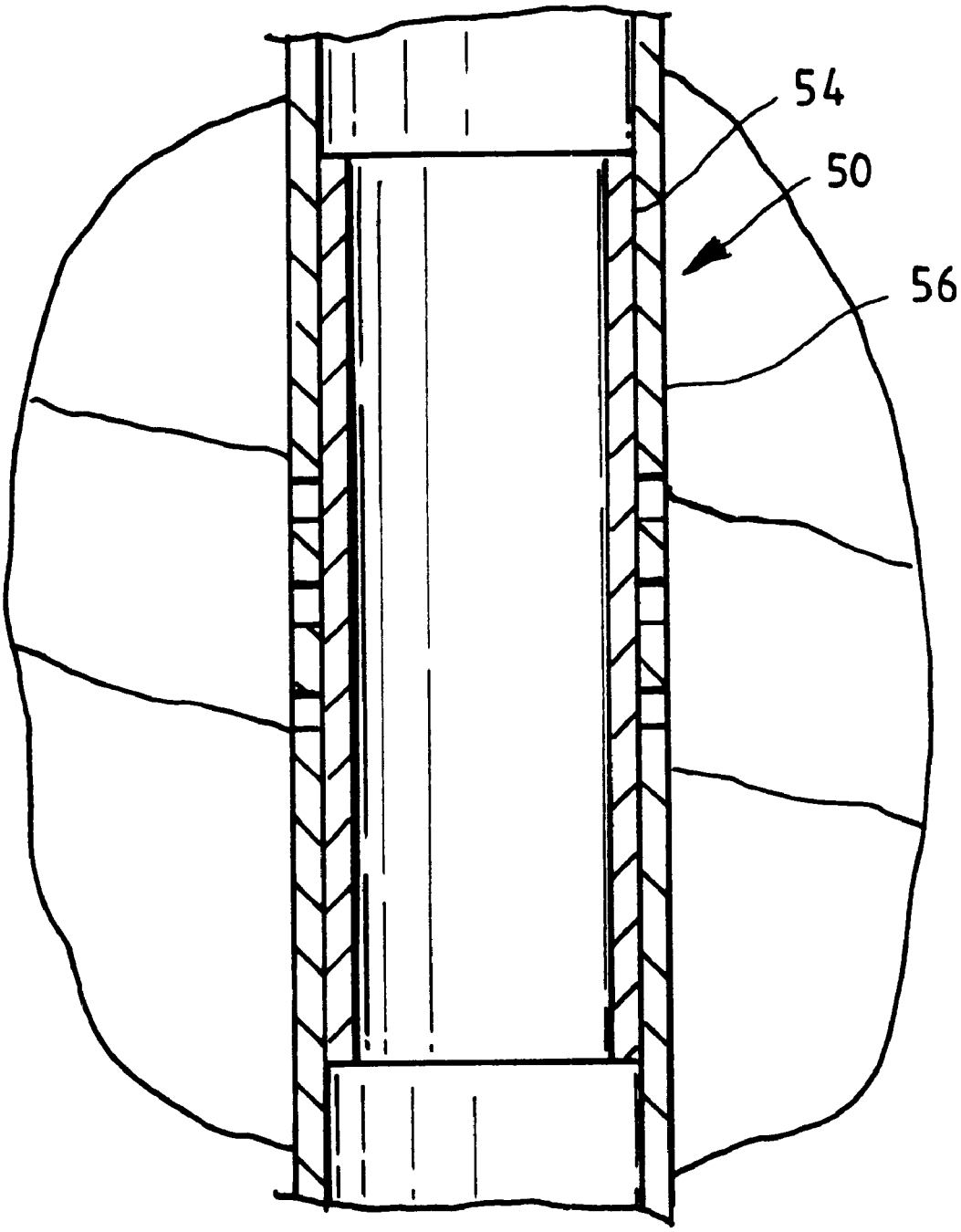

These and other aspects of the present invention will now be described, by way of example, with reference to the accompanying drawings, in which:

FIGS. 1 and 2 are schematic sectional views of a straddle setting operation in accordance with an embodiment of an aspect of the present invention; and FIG. 3 is a schematic sectional view of a straddle in accordance with another embodiment of the present invention.

Reference is first made to FIG. 1 of the drawings, which illustrates a straddle 10 in accordance with an embodiment of the present invention located in a section of a drilled bore 12 lined with perforated steel liner 14. The straddle 10 has been run into the bore 12 and will be utilised to isolate a section of the bore 12, in particular a particular formation 16 which is in fluid communication with the bore via perforations 18 in a section of the liner 14.

The straddle 10 comprises a section of expandable tubing 20 carrying seal bands 22 of relatively ductile metal at each end, and also grip bands 23 comprising small elements of relatively hard material in a relatively ductile matrix. The tubing 20 defines a solid wall and is of slightly smaller outside diameter than the liner 14. Initially, the tubing 20 is of substantially constant diameter along its length. The ends of the tubing 20*a*, 20*b* and formed of relatively ductile metal and are welded to a central tubing section 20*c*.

The straddle is run into the bore 12 on a tool string 26, and is mounted to the string 26 via an expander device 28 mounted to the lower end of the string 26. The expander device 28 comprises a body 30 carrying three radially movable rollers 32. The body 30 also contains an axially movable piston which is coupled to a loading cone which cooperates with the tapered ends of the rollers 32. Application of elevated fluid pressure, via the tool string 26, thus urges the rollers 32 radially outwardly. Shear pins 34 couple the straddle 10 to the expander body 30.

In use, the straddle is run into the bore 12 on the tool string 26 and positioned across the group of perforations 18 to be closed off from the bore. Pressure is then applied to the expander 28 to activate the rollers 32; an initial application of elevated pressure causes the rollers 32 to extend radially, and deforms the tubing 20, towards a triangular form, such that the areas of tubing 20 adjacent the rollers 32 are pushed into contact with the inner surface of the liner 14. This initial contact is sufficient to prevent relative rotation between the straddle 10 and the liner 14, much that when the string 26 and the expander 28 are rotated from surface the straddle 10 is held relative to the liner 14 and the pins 34 shear. The expander 28 then rotates within the straddle 10 with the rollers 32 in rolling contact with the inner wall of the tubing 20. The rollers 32 are urged outwardly and progressively compress the tubing wall to create a localised reduction in wall thickness, and a corresponding increase in wall diameter. There is thus created a annular section of increased tubing diameter 36 at the tubing end section 20*a,* as shown in FIG. 2, which provides an interference fit with the surrounding liner 14, the sealing bands 22 being deformed to form a fluid-tight seal between the expanded tubing 36 and the liner 14. The hard material in the grip bands 23 also assists in keying the tubing section 36 to the liner 14. There may be a degree of elastic and even plastic deformation of the liner 14, which will serve to provide a more secure location for the straddle 10.

Following creation of the annular extension 36, the pressure in the tool string 26 is reduced such that the rollers 32 may retract. The expander 28 is then advanced towards the lower end of the straddle 10, and engages a stop 38 provided on the lower end of the tubing 20. The pressure in the tool string is then increased once more to actuate the rollers 32, and the expander 28 is rotated to create a second annular section of increased diameter 40.

The expander 28 may then be deactivated and retrieved from the bore, leaving the straddle 10 locked in place in the bore, and serving to isolate the formation 16 from the bore.

To remove the straddle 10, the locking and sealing sections 36, 40 are milled out, and the remaining section of tubing then removed.

In other embodiments, the increased diameter sections 36, 40 may be formed simultaneously, by provision of two expanders located one at either end of the straddle.

Reference is now made to FIG. 3 of the drawings, which illustrates a permanent straddle 50 in accordance with another embodiment of the invention locked and sealed in a bore 52. The straddle 50 is located in a substantially similar manner to the straddle 10 described above, however the straddle tubing 54 has been deformed along its whole length, such that there is a much larger area of contact between the tubing 54 and the surrounding liner 56, and a smaller loss in cross-section in the liner 56 from the provision of the straddle 50.

Those of skill in the art will recognise that the above described embodiments of the present invention provide straddles which are relatively simple in construction and installation and which avoid many of the problems associated with prior art straddles featuring slips and energisable elastomer seals.

Those of skill in the art will also recognize that the embodiments described herein are merely exemplary and that various modifications and improvements may be made thereto without departing from the scope of the present invention. For example, the above described embodiments are shown isolating sections of formation from a bore lined with perforated liner. In other embodiments, the straddle may be utilised to repair damaged tubing, including risers, casing, liner or production tubing. The straddle may be run in on any suitable form or tool string, including reeled supports such as coiled tubing, when the straddle will be provided in combination with a downhole motor for rotating the expander 28.

What is claimed is:

1. A method of isolating a section of downhole tubing, comprising:

running a length of expandable tubing into a tubing-lined borehole and positioning the expandable tubing across a section of tubing to be isolated, wherein the expandable tubing comprises an outer face having relatively hard elements held together in a matrix disposed thereon; and deforming at least one portion of the expandable tubing to increase the diameter of said portion to sealingly engage the tubing to be isolated.

2. The method of claim 1, wherein the expandable tubing is deformed at least in part by compressive plastic deformation creating a localised reduction in wall thickness and increase in diameter.

3. The method of claim 2, wherein the deformation is achieved by rolling expansion, that is an expander device rotated within the expandable tubing with an expander member in rolling contact with an inner face of the expandable tubing.

4. The method of claim 1, wherein the deformation of the expandable tubing creates an annular extension.

5. The method of claim 4, wherein the annular extension extends over a substantial portion of the expandable tubing.

6. The method of claim 5, wherein the annular extension extends over selected portions of the expandable tubing on either side of the section of tubing to be isolated.

7. The method of claim 1, wherein the expandable tubing includes relatively ductile portions corresponding to the portions of the tubing to be expanded.

8. The method of claim 1, wherein the expandable tubing is initially cylindrical.

9. The method of claim 1, wherein the expandable tubing is deformed by a means for expanding comprising a body carrying a plurality of expander roller members.

10. The method of claim 9, wherein the plurality of expander roller members are radially extendable and the expander device is rotated to deform the expandable tubing.

11. The method of claim 1, wherein seal bands are provided on an outer face of the expandable tubing and are compressed between the deformed portions of the expandable tubing and the surrounding tubing.

12. The method of claim 1, wherein grip bands comprising the relatively hard elements are disposed on the outer face of the expandable tubing to engage the deformed portions of the expandable tubing with the surrounding tubing.

13. A method of isolating a section of downhole tubing, comprising:

running expandable tubing into a wellbore;

positioning the expandable tubing across a section of tubing to be isolated, wherein the expandable tubing comprises an outer face having relatively hard elements held together in a matrix and one or more seal bands disposed thereon; and deforming the expandable tubing to increase a diameter thereof to sealingly engage the tubing to be isolated.

14. The method of claim 13, wherein one or more grip bands comprising the relatively hard elements are disposed on the outer face of the expandable tubing.

15. The method of claim 13, wherein the outer face comprises at least two grip bands and the one or more seal bands are disposed about the face between the grip bands.

16. The method of claim 14, wherein the one or more grip bands comprise balls, chips, or grains held in a matrix to bite into the tubing to be isolated upon deformation of the expandable tubing.

17. The method of claim 13, wherein the one or more seal bands comprise an elastomer.

18. The method of claim 13, wherein the one or more seal bands comprise copper or a tin/lead alloy.

19. A method of isolating a section of downhole tubing, comprising:

running expandable tubing into a wellbore;

positioning the expandable tubing across a section of tubing to be isolated, wherein the expandable tubing comprises an outer face having relatively hard elements held together in a matrix and one or more seal bands disposed thereon; and deforming a first end of the expandable tubing to form a fluid-tight seal between the expandable tubing and the tubing to be isolated; and deforming a second end of the expandable tubing to form a fluid-tight seal between the expandable tubing and the tubing to be isolated.

20. The method of claim 19, further comprising deforming an entire length of the expandable tubing.

21. The method of claim 19, wherein one or more grip bands comprising the relatively hard elements are disposed on the outer face of the expandable tubing.

22. The method of claim 19, wherein the outer face comprises at least two grip bands and the one or more seal bands are disposed about the face between the grip bands.

23. The method of claim 21, wherein the one or more grip bands comprise balls, chips, or grains held in a matrix to bite into the tubing to be isolated upon deformation of the expandable tubing.

24. The method of claim 19, wherein the one or more seal bands comprise an elastomer.

25. The method of claim 19, herein the one or more seal bands comprise copper or a tin/lead alloy.

26. A method of isolating a section of downhole tubing, comprising:

running a length of expandable tubing into a wellbore and positioning the expandable tubing across a section of wellbore to be isolated; and deforming at least a first portion of the expandable tubing to increase the diameter of said first portion to sealingly engage the wellbore to be isolated, the deformation accomplished with an expander tool having at least one radially extendable member that is urged outwards by the application of fluid pressure thereto, wherein the radially extendable member comprises one or more rollers each mounted on one or more slideable pistons that are sealably disposed within one or more recesses on the expander tool's outer surface.

27. The method of claim 26, wherein the at least one extendable member is retracted after the first portion is deformed.

28. The method of claim 26, wherein the expander tool includes three extendable members equally spaced about a circumference of the tool.

29. The method of claim 26, further comprising deforming at least a second portion of the expandable tubing.

30. The method of claim 29, wherein the second portion is deformed at a predetermined distance from the first deformed portion of the expandable tubing.

* * * * *